US005908011A

United States Patent [19]

Stauffer et al.

[11] Patent Number: 5,908,011

[45] Date of Patent: Jun. 1, 1999

[54] REDUCED LENGTH ENGINE GENERATOR ASSEMBLY

[75] Inventors: E. Tony Stauffer, Ephrata; Travis J. Stauffer, Reinholds, both of Pa.

[73] Assignee: Stauffer Diesel, Inc., Ephrata, Pa.

[21] Appl. No.: 09/017,322

[22] Filed: Feb. 2, 1998

[51] Int. Cl.[6] ..... F02B 63/04

[52] U.S. Cl. ..... 123/2; 123/198 E; 123/41.01; 290/1 A

[58] Field of Search ..... 123/2, 198 E, 123/41.01; 290/1 A

[56] References Cited

U.S. PATENT DOCUMENTS

| | | | |
|---|---|---|---|
| 4,495,901 | 1/1985 | Nannini et al. | 123/2 |
| 4,702,201 | 10/1987 | Odo et al. | 123/2 |
| 4,733,750 | 3/1988 | Poirier et al. | 181/202 |
| 4,835,405 | 5/1989 | Clancey et al. | 290/1 |
| 5,121,715 | 6/1992 | Nogami et al. | 123/41.7 |
| 5,174,406 | 12/1992 | Lee | 123/41.31 |
| 5,234,051 | 8/1993 | Weizenburger et al. | 123/41.31 |
| 5,433,175 | 7/1995 | Hughes et al. | 290/1 |
| 5,515,816 | 5/1996 | Ball et al. | 290/1 |
| 5,624,589 | 4/1997 | Latvis et al. | 290/1 |
| 5,778,832 | 7/1998 | King et al. | 123/2 |

*Primary Examiner*—Noah P. Kamen
*Attorney, Agent, or Firm*—Martin Fruitman

[57] ABSTRACT

The apparatus is an enclosed engine generator assembly with air intake and air discharge openings into the enclosure in which the engine is installed and the radiator for engine cooling moved from the conventional position in front of the engine to a location at the bottom of the enclosure and between the supports for the assembly. The arrangement permits an assembly with a shorter overall length, but no significant increase in the height, which facilitates installation aboard vehicles.

15 Claims, 2 Drawing Sheets

REDUCED LENGTH ENGINE GENERATOR ASSEMBLY

BACKGROUND OF THE INVENTION

This invention deals generally with engine generator sets and more specifically with the layout of the various engine generator components to reduce the size of the enclosure within which an engine generator may be operated.

Engine generator sets are much more common in our society than one would first suspect. Recreational vehicles frequently have them aboard in order to generate the power to run appliances and entertainment devices without running the much larger vehicle engine. Furthermore, virtually all emergency vehicles, other than police cars, also have independent engine generators for lights and other necessary equipment.

Because all equipment aboard such vehicles is actually competing for space, there is continuing effort to reduce the size of on-board engine generators, but such equipment has unique requirements. First, because the engine of the combination produces significant audible noise, they are usually installed in a sound insulated enclosure. However, since the engine requires combustion air and generates exhaust gases and heat, there must be openings into the enclosure for cool air inlet and hot air and exhaust outputs. Furthermore, such engine generator sets are usually installed on the vehicles in such a manner that there is no access to the engine and generator from the top, from one side, or from either end of the engine generator axis. This leaves only one side and the bottom of the enclosure for access not only for cooling, but also for servicing. Since standard engine generator sets require axially air flow through a front mounted radiator, ducting must be added to the front of the set to pull air in, and that adds considerably to the length of the enclosure.

There is substantial benefit to be derived from an engine generator installation with a reduced length, provided there is no required increase in height or width of the enclosure.

SUMMARY OF THE INVENTION

The present invention furnishes a significant reduction in the length of an engine generator set by relocating the radiator of the internal combustion engine. The radiator is moved from the conventional location in front of the engine driven fan to an otherwise unused space between the frame rails which support the engine generator set. This relocation reduces the overall length of the engine generator assembly by five to twelve inches, but adds nothing to either the height or the width of the assembly.

To derive the full benefit of the new location of the radiator, it is desirable to place the engine generator assembly in a separate enclosure of its own. This permits determining the air flow path through the enclosure by locating an air inlet for the engine generator assembly enclosure directly in front of the engine fan and an air discharge opening just below the radiator, which is located below the generator. The resulting air flow path within the enclosure not only cools both the engine and the generator, but also furnishes combustion air for the engine.

The space between the engine generator enclosure and the wall of the vehicle compartment within which the enclosure is placed then acts essentially as an air intake duct feeding the engine enclosure air inlet from a vehicle compartment air intake. This vehicle compartment air intake can be located either in the bottom of the compartment near the front of the engine of the engine generator set, where it is spaced away from the hot air discharge under the generator, or it can be placed in the one accessible side wall of the compartment, which is usually an access door to the vehicle compartment.

An alternative embodiment of the invention uses an independently driven cooling fan, such as one powered by an electrical or hydraulic motor, in place of the conventional engine driven fan. This independent fan is placed in an opening of a smaller enclosure which contains only the generator, and the enclosure has an air discharge adjacent to the radiator which is between the frame rails. For such an embodiment, the air flow path into the vehicle compartment can be through air intakes regardless of their location, because the independent fan draws the air from the vehicle compartment into the generator enclosure and supplies the air for the generator and out past the radiator. However, for this embodiment the two preferred locations for the air intakes into the vehicle compartment would be the same as the locations for the preferred embodiment, under the front of the engine or in an accessible side wall of the vehicle compartment.

Since the height and depth of the generator is less than the height and depth of the engine and it accessories, the independent fan can be located beside or above the generator with no increase in the height or depth of the assembly. Thus, since both the radiator and the engine driven fan are removed from in front of the engine, the overall length of an engine generator set using the alternate embodiment of the invention is several inches less than the reduced overall length afforded by the preferred embodiment which still includes the fan in front of the internal combustion engine.

The present invention thereby reduces the length, and, of course, the volume of the compartment required for an engine generator set installed on a vehicle.

DETAILED DESCRIPTION OF THE INVENTION

Figure 1:
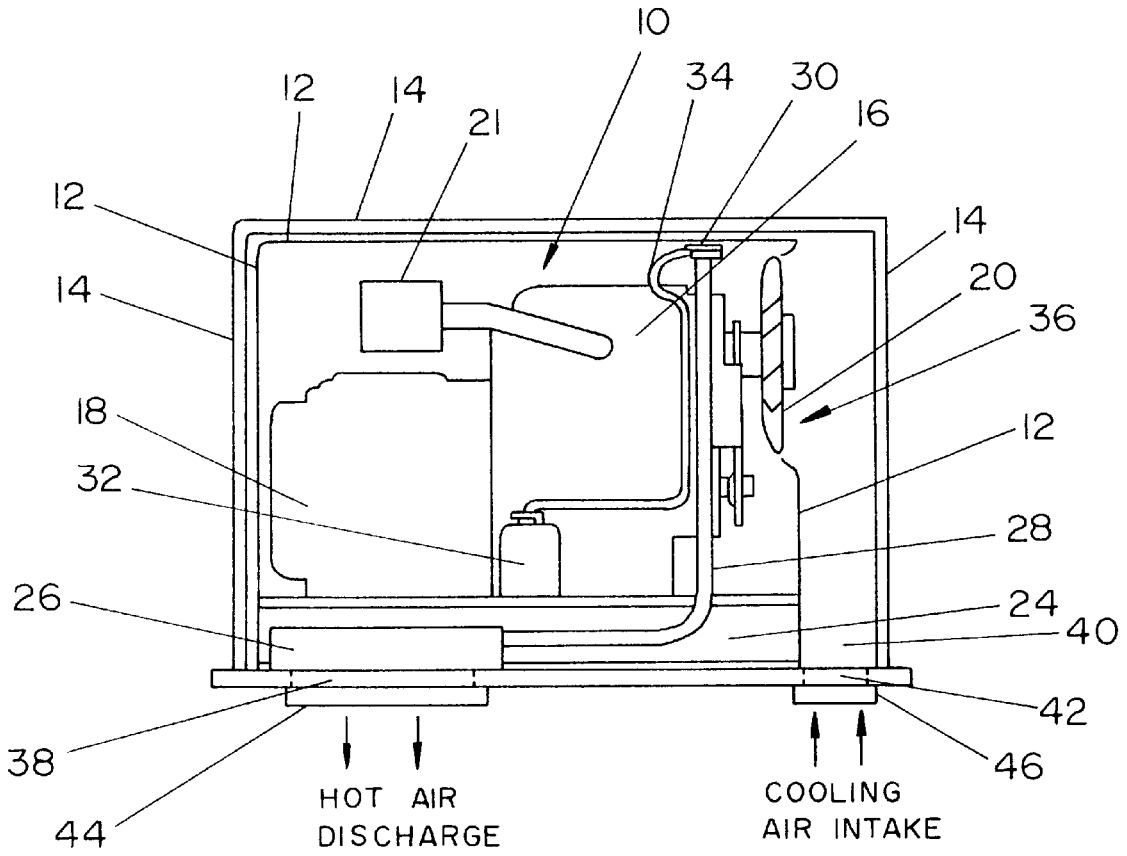
FIG. 1 is a side view showing the layout of the major components of an engine generator set of the preferred embodiment of the invention.

FIG. 1 is a side view showing the layout of the major components of engine generator assembly 10 of the preferred embodiment of the invention. Engine generator assembly 10 is located within enclosure 12, which is itself typically located within compartment 14 aboard a vehicle (not shown). For ease of viewing the invention both enclosure 12 and compartment 14 are shown without their vertical near walls, which are typically hinged doors or removable service access panels.

Engine generator assembly 10 includes liquid cooled, internal combustion engine 16 and electrical generator 18 which are conventionally mechanically interconnected so that engine 16 drives generator 18 which produces electrical power. Engine 16 and generator 18 both have the accessories which are conventionally associated with such devices, such as engine fan 20 and engine air intake filter 21, but most such accessories are not shown because they are not pertinent to the present invention.

Engine 16 and generator 18 are mounted across the top of support beams 24. Support beams 24 are conventional "I" or channel beams. This is a conventional support system in the prior art because it furnishes satisfactory strength and rigidity, and provides a space below engine 16 and generator 18 to aid in moving assembly 10. In FIG. 1 the nearest of the two typical support beams 24 is not shown in place so that the location of radiator 26 can be seen with greater clarity.

Radiator 26 is interconnected with the liquid cooling system of engine 16 through pipes 28, the second of which is behind the one shown, and the present invention locates radiator 26 in a unique position between support beams 24 and below engine 16 and generator 18. This location furnishes the benefit of reducing the length of engine generator assembly 10 by several inches, at least the distance equal to the thickness of radiator 26 and the clearance normally required between radiator 26 and engine fan 20.

In the prior art, radiator 26 is, of course, adjacent to fan 20, on the opposite side of the fan from engine 16. However, the new location for radiator 26 provided in the present invention not only reduces the overall length of engine generator assembly 10, but adds no height or width to the assembly. The location between support beams 24 and below generator 18 has previously been available but unused space.

The relocation of radiator 26 requires some other minor modifications in the structure of engine generator assembly 10. For instance, coolant refill cap 30 is no longer attached directly to radiator 26 as in the prior art. Instead, refill cap 30 is located at the highest part of the coolant system, atop engine 16, and coolant pipe 28, which is connected to radiator 26, is attached to the usual short stub of pipe to which refill cap 30 is connected. Coolant reservoir 32 is then connected to the coolant system in conventional fashion by hose 34 attached below refill cap 30.

Because radiator 26 is not located adjacent to fan 20, some changes are also required to properly direct the cooling air stream through radiator 26. This is largely accomplished by locating engine generator assembly 10 within enclosure 12 which has only air inlet opening 36 located adjacent to fan 20 and air discharge opening 38 at radiator 26. Therefore, cooling air flows into enclosure 12 through air inlet opening 36, pulled in by fan 20, and then moves through enclosure 12, past engine 16 and generator 18, and out of enclosure 12 by going through radiator 26 and out air discharge opening 38. This cooling air also is available to engine air intake filter 21 to supply combustion air for engine 16.

When engine generator assembly 10 is used in a typical application within compartment 14 aboard a vehicle (not shown), enclosure 12 and compartment 14 can be used to determine the boundaries of air duct 40 for feeding cooling air to air inlet opening 36 of enclosure 12. In that situation, an additional air intake 42 is placed in a wall of compartment 14 to furnish air to air duct 40 from outside compartment 14.

When engine generator assembly 10 is located aboard a vehicle it is desirable to protect air discharge opening 38 and air intake 42 from road spray and dirt. To accomplish that, shield 44 is placed over air discharge opening 38, and air filter 46 is placed over air intake opening 42. Air coming into air inlet opening 36 of enclosure 12 must therefore pass through air filter 46, and shield 44 prevents radiator 26 from being affected from contaminants from the outside environment.

Figure 2:
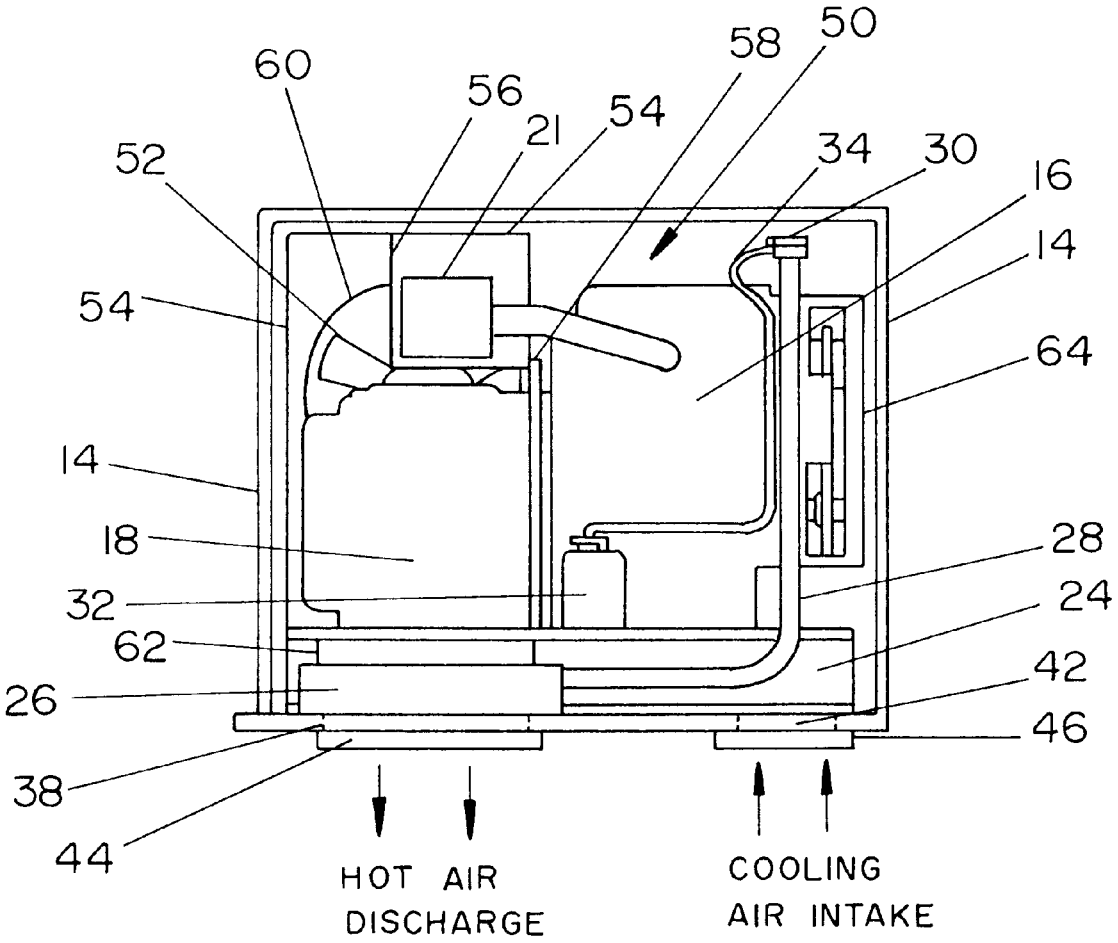
FIG. 2 is a side view showing the layout of the major components of an engine generator set of an alternate embodiment of the invention.

FIG. 2 is a side view showing the layout of the major components of engine generator set 50 of an alternate embodiment of the invention. Most of the components of engine generator assembly 50 are identical to those of engine generator assembly 10 of FIG. 1 and are therefore labeled with the same identifying numbers.

The essential difference between engine generator assembly 50 of FIG. 2 and engine generator assembly 10 of FIG. 1, is that engine fan 20 is not included in FIG. 2. Instead, independently driven fan 52 is installed within enclosure 54. Enclosure 54 is smaller than enclosure 12 of FIG. 1 because it encloses only generator 18. Enclosure 54 includes indentation 56 which permits engine air intake filter 21 to remain external to enclosure 54, and it also has circumferential flexible sealing joint 58 surrounding the junction of engine 16 and generator 18 to minimize air loss at the point where it crosses the part of generator 18 that is attached to engine 16.

Enclosure 54 includes air inlet opening 60 through which cooling air is drawn into enclosure 54 by fan 52, and fan 52 also pushes air from within enclosure 54 out exhaust duct 62, through radiator 26, and out air discharge opening 38. When engine generator assembly 50 is located within vehicle compartment 14 as shown in FIG. 2, the air entering enclosure 54 through air inlet opening 60 is first drawn into compartment 14 through air intake 42 in the same manner as in the embodiment shown in FIG. 1. The air flow path is then across engine 16, into enclosure 54, across generator 18, and through radiator 26.

As can be seen in FIG. 2, the removal of the engine driven fan further foreshortens engine generator assembly 50 by several inches, most of the depth of the engine driven fan. However, even after removing the fan some rotating parts remain at the front of the engine, and it is desirable to cover those parts with guard 64.

The invention therefore yields a reduction in length without any increase in other dimensions, provides a compact unit usable aboard vehicles with either water or oil cooled engines, and permits simple installation with only two openings for air intake and discharge. Of course, another opening can be included for the engine exhaust.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the air intake into the vehicle compartment can also be located on a vertical wall of the compartment such as the door or access panel which is not shown in the drawings, and the supports below the engine and generator can be constructed in configurations other than beams.

What is claimed as new and for which letters patent of the united states are desired to be secured is:

1. In an engine generator assembly with a liquid cooled internal combustion engine connected to and driving an electrical generator and including a radiator interconnected to the engine liquid cooling system, the improvement comprising:

supports upon which the engine and generator are mounted;

a radiator interconnected to the engine liquid cooling system and located between the supports;

a walled enclosure enclosing the engine and generator;

a first opening in an enclosure wall and located adjacent to the radiator so that air moving through the first opening also moves through the radiator;

a second air opening in an enclosure wall with access to air outside the enclosure; and a fan located within the enclosure, moving air into the enclosure through one air opening and moving air from within the enclosure out the other air opening.

2. The engine generator assembly of claim 1 wherein the fan is mechanically connected to and driven by the engine.

3. The engine generator assembly of claim 1 wherein the fan is mechanically connected to and driven by the engine and an air inlet opening is located adjacent to the fan.

4. The engine generator assembly of claim 1 wherein the fan is driven by an independently powered motor.

5. The engine generator assembly of claim 1 wherein the radiator is located within the enclosure.

6. The engine generator assembly of claim 1 wherein the radiator is located directly below the generator.

7. The engine generator assembly of claim 1 wherein the enclosure is within a walled compartment located in a vehicle, and there is space between the enclosure and the walls of the compartment forming an incoming air duct to supply air to an enclosure air inlet opening from an opening in a wall of the compartment.

8. The engine generator assembly of claim 1 wherein the enclosure is within a walled compartment located in a vehicle, and there is an air outlet opening in a wall of the compartment adjacent to the radiator.

9. The engine generator assembly of claim 1 wherein the radiator is protected by a shield located between the radiator and the outside environment.

10. The engine generator assembly of claim 1 further including an air filter located so that air entering the enclosure first passes through the air filter.

11. In an engine generator assembly with a liquid cooled internal combustion engine connected to and driving an electrical generator and including a radiator interconnected to the engine liquid cooling system, the improvement comprising:

at least two supports upon which the engine and generator are mounted;

a radiator interconnected to the engine liquid cooling system and located between the supports; and a fan moving air through the radiator.

12. The engine generator assembly of claim 11 wherein the radiator is located directly below the generator.

13. The engine generator assembly of claim 11 wherein the radiator is protected by a shield.

14. The engine generator assembly of claim 11 further including an air filter located so that air moving through the radiator first passes through the air filter.

15. The engine generator assembly of claim 11 wherein the assembly is within a walled compartment located in a vehicle, and there is an air opening in a wall of the compartment adjacent to the radiator.

* * * * *